US008585003B2

(12) United States Patent
Entis

(10) Patent No.: US 8,585,003 B2
(45) Date of Patent: Nov. 19, 2013

(54) POSTER-COASTER

(76) Inventor: Allan C. Entis, Tel Aviv (IL)

( * ) Notice: Subject to any disclaimer, the term of this patent is extended or adjusted under 35 U.S.C. 154(b) by 0 days.

(21) Appl. No.: 12/980,389

(22) Filed: Dec. 29, 2010

(65) Prior Publication Data

US 2011/0155885 A1 Jun. 30, 2011

Related U.S. Application Data

(60) Provisional application No. 61/291,399, filed on Dec. 31, 2009.

(51) Int. Cl.
*A47B 91/00* (2006.01)

(52) U.S. Cl.
USPC ..... 248/346.11

(58) Field of Classification Search
USPC ..... 238/346.11; 248/346.11; 206/217
See application file for complete search history.

(56) References Cited

U.S. PATENT DOCUMENTS

| | | | | |
|---|---|---|---|---|
| 5,000,413 | A * | 3/1991 | Kawashima | 248/346.11 |
| 5,018,695 | A | 5/1991 | Bishop | |
| 6,102,352 | A * | 8/2000 | Kvalvog | 248/346.11 |
| 7,331,194 | B2 * | 2/2008 | Lefkowitz et al. | 62/457.4 |
| 2008/0272261 | A1 | 11/2008 | Morlan | |

* cited by examiner

*Primary Examiner* — Alfred J Wujciak
(74) *Attorney, Agent, or Firm* — A.C. Entis-IP Ltd.

(57) ABSTRACT

A stack of coasters each having a liquid absorbent layer and a material that prevents liquid from penetrating through the coaster, the coasters adhered together in the stack by an adhesive that enables each coaster to be readily removed from the stack.

6 Claims, 5 Drawing Sheets

POSTER-COASTER

CROSS-REFERENCES TO RELATED APPLICATIONS

The present application claims benefit under 35 U.S.C. §119(e) of U.S. Provisional Application 61/291,399 filed Dec. 31, 2009, the entire content of which is incorporated herein by reference.

TECHNICAL FIELD

Embodiments of the invention relate to coasters for protecting a surface from damage by an object supported by the surface.

BACKGROUND

People repeatedly put containers of hot or cold drinks on a surface of a table, or a desk at which they are working and use a coaster to protect the surface from damage by liquid spilled from the container or by liquid condensed on surfaces of the container.

SUMMARY

An embodiment of the invention provides a stack of disposable coasters that are adhered together so that a top coaster in the stack may readily be removed from the stack and disposed of when it is soiled. Each coaster comprises a liquid absorbent material and a material that operates to prevent moisture from penetrating through the coaster so that liquid soiling a top coaster in the stack does not penetrate and soil a coaster beneath it.

In an embodiment of the invention, the coaster comprises a layer, of material, hereinafter a "writable material", such as a paper, adapted for writing thereon. Optionally, the "writable layer" comprises at least a portion of the liquid absorbent material. In some embodiments of the invention, the writable layer is bonded to a layer of the absorbent material. For convenience of presentation it is assumed that the writable layer comprises the absorbent material.

Optionally, the "writable layer", is bonded to a layer of material such as a lacquer or plastic that prevents moisture from penetrating from one side to the other of the coaster. In some embodiments of the invention, the coaster comprises a layer of writable material impregnated by a material, such as a suitable polymer, that makes at least a portion of the writable material impermeable to liquid.

Optionally, each coaster is adhered to a coaster beneath it in the stack by an adhesive configured by composition and/or location, using any of various methods and/or materials known in the art such as those used to produce sticky notes, so that the coaster is serviceable as a sticky note.

As a result of each coaster comprising a layer of material impermeable to liquid, a glass or cup comprising a liquid may be placed on the stack of coasters and wet a top coaster in the stack with liquid as a result of spillage or condensation, without the liquid penetrating to and soiling the coaster beneath it. When the glass is removed, the wetted coaster on the top of the stack may easily be peeled away from the stack and disposed of, leaving a fresh new coaster beneath it.

The following names are optionally used herein to refer to a disposable coaster in accordance with an embodiment of the invention: "Poster-Coaster", "CoasterNota", and "Nota-Coaster". A stack of PosterCoasters is optionally referred to as a "Poster-Coaster Pack".

BRIEF DESCRIPTION OF FIGURES

Non-limiting examples of embodiments of the invention are described below with reference to figures attached hereto that are listed following this paragraph. Identical structures, elements or parts that appear in more than one figure are generally labeled with a same numeral in all the figures in which they appear. Dimensions of components and features shown in the figures are chosen for convenience and clarity of presentation and are not necessarily shown to scale.

DETAILED DESCRIPTION

Figure 1A:
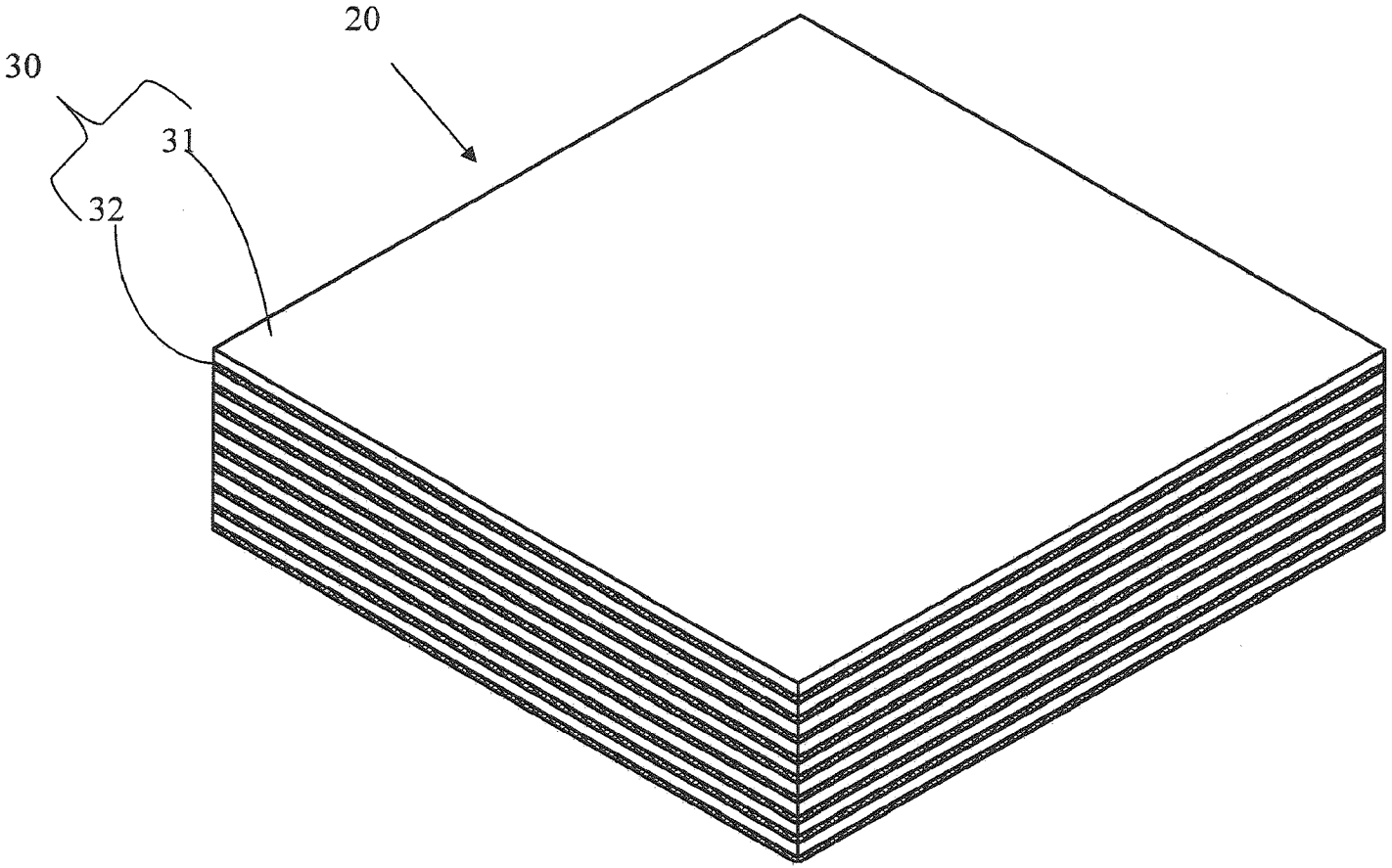
FIG. 1A schematically shows a perspective view of a stack of coasters, in accordance with an embodiment of the invention.

FIG. 1 schematically shows a perspective view of a stack 20 of coasters 30, in accordance with an embodiment of the invention.

Each coaster 30 in stack 20 optionally comprises a writable layer 31 bonded to a layer 32, hereinafter referred to as an "impermeable layer", which operates to prevent liquid staining a top coaster 30 in stack 20 from staining a coaster beneath it in the stack. Any of various materials and methods known in the art may be used to provide liquid impermeable layer 32. For example, impermeable layer 32 may comprise a lacquer or plastic applied to writable layer 31 by spraying, rolling or heat bonding. Coasters 30 in stack 20 are adhered to each other, using any of various methods known in the art so that each coaster may be readily removed from the stack.

By way of example, in some embodiments of the invention, coasters 30 are adhered together in stack 20 by providing each coaster with an adhesive located on a surface region of the coaster that adheres the coaster to an adjacent coaster. FIG. 1B schematically shows a coaster 30 having a band of adhesive 33 along an edge of impermeable layer 32. Adhesive 33 serves to adhere coaster 30 to a coaster immediately below it in stack 20 and is optionally formed using any of various methods and/or materials known in the art such, as those used to produce sticky notes, so that coaster 30, which comprises writable layer 31, is serviceable as a sticky note.

Figure 1C:
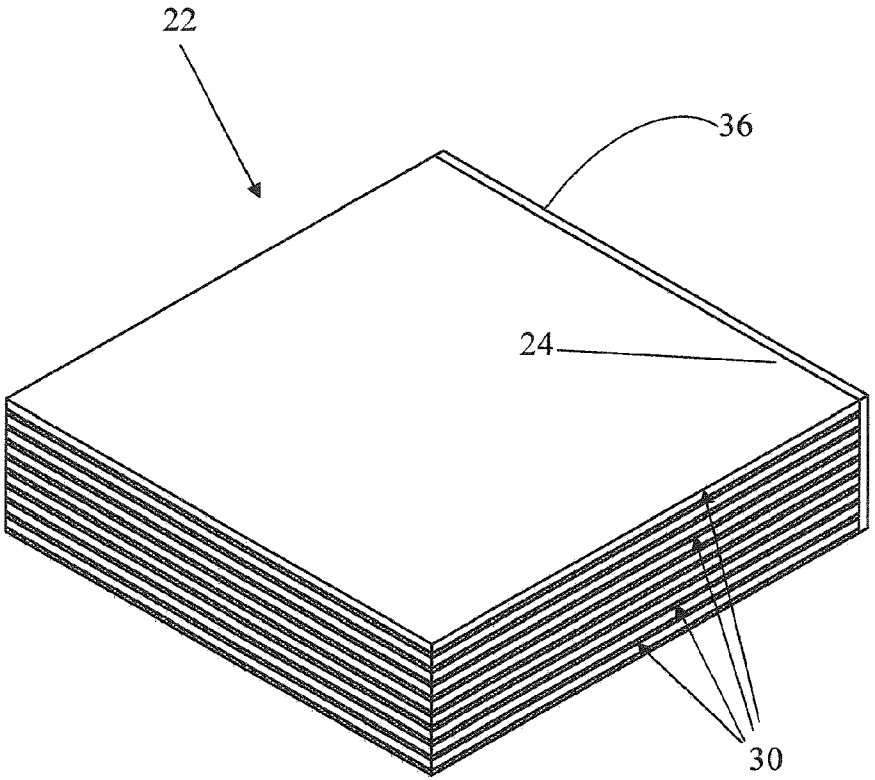
FIG. 1C schematically shows a perspective view of another stack of disposable coasters, in accordance with an embodiment of the invention.
Figure 1B:
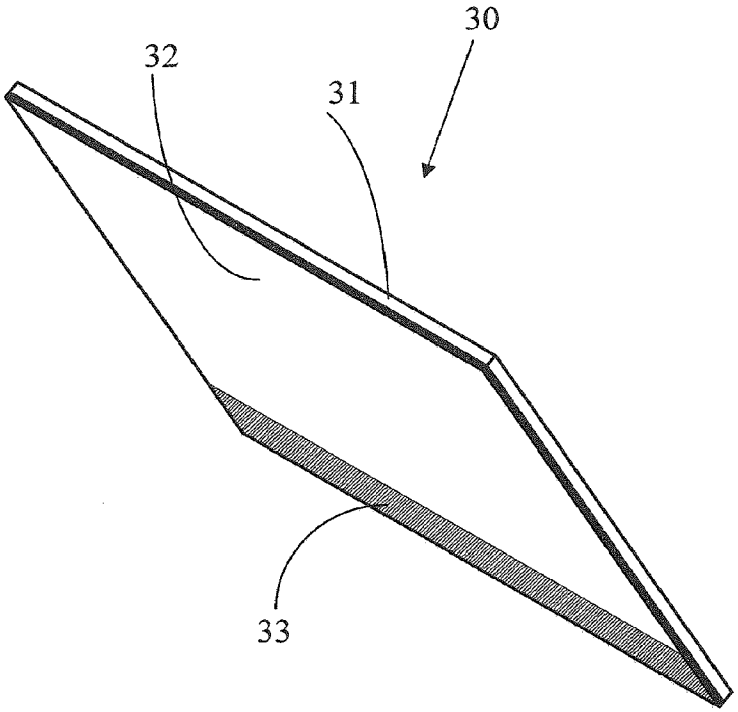
FIG. 1B schematically shows a coaster having a band of adhesive for adhering the coaster to another coaster in the stack of coasters shown in FIG. 1A, in accordance with an embodiment of the invention.

By way of another example, FIG. 1C schematically shows a stack 22 of coasters 30 in which the coasters are adhered together by a bonding layer 36 that adheres to edges of the coasters located along a same side 24 of the stack. Any of various methods and material known in the art, may be used to form bonding layer 36.

Figure 2:
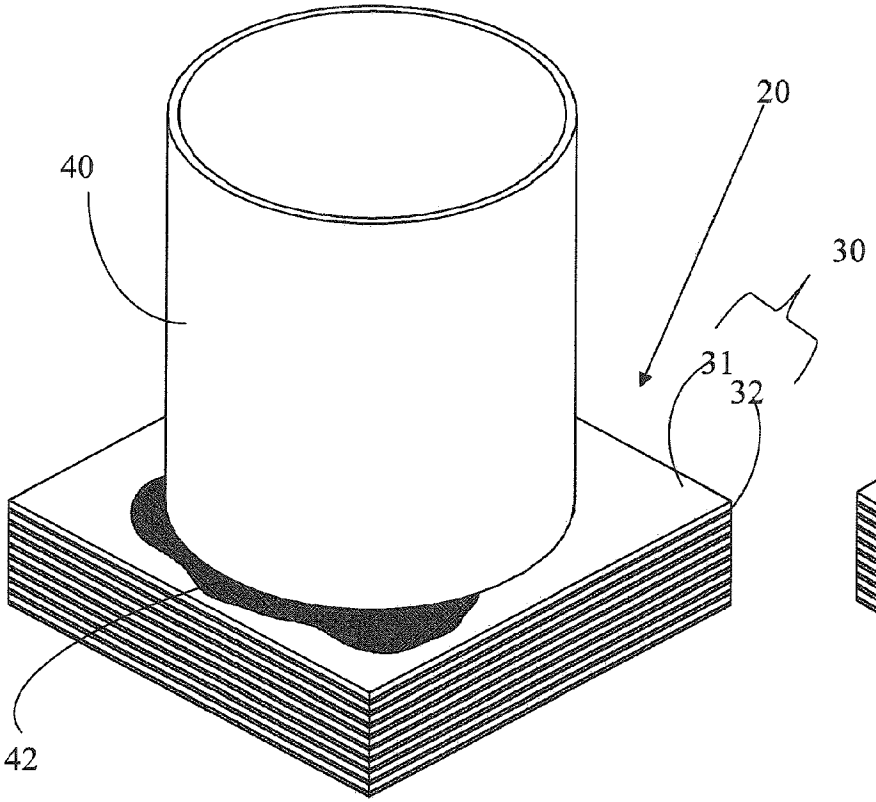
FIG. 2 schematically shows a container placed on the stack of coasters shown in FIG. 1 and liquid that was spilled from the container staining a top coaster in the stack, in accordance with an embodiment of the invention.

FIG. 2 schematically shows a container 40 placed on coaster stack 20 shown in FIG. 1 and liquid 42 that was spilled from the container staining a top coaster 30 in the stack, in accordance with an embodiment of the invention. Because the top coaster comprises impermeable layer 32, liquid 42 does not penetrate through the coaster and stain a coaster in stack 20 immediately below it.

Figure 3:
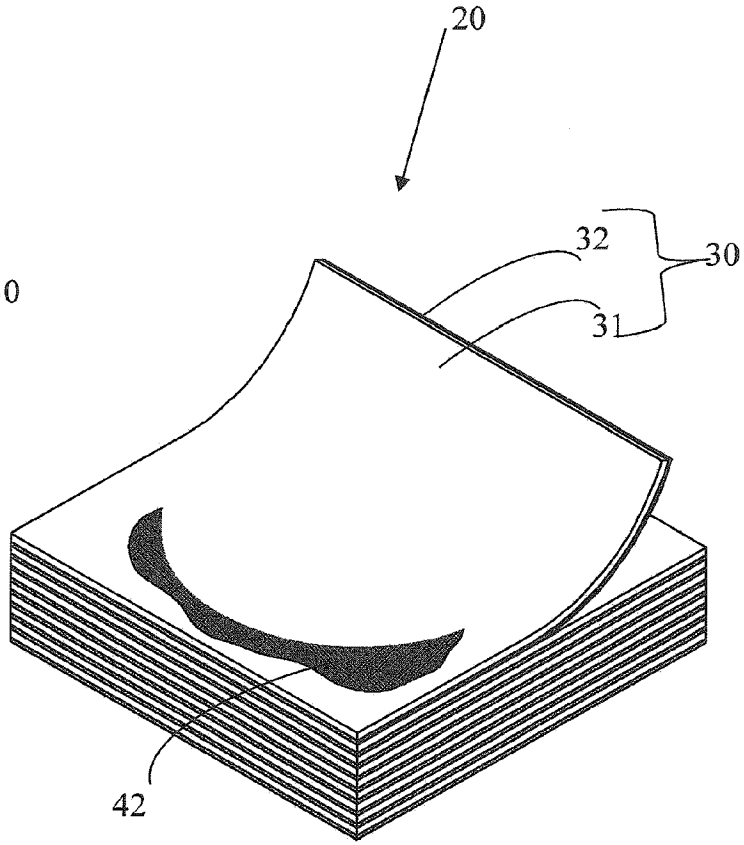
FIG. 3 schematically shows the stack of coasters shown in FIG. 2 with the stained coaster being removed, in accordance with an embodiment of the invention.
Figure 4:
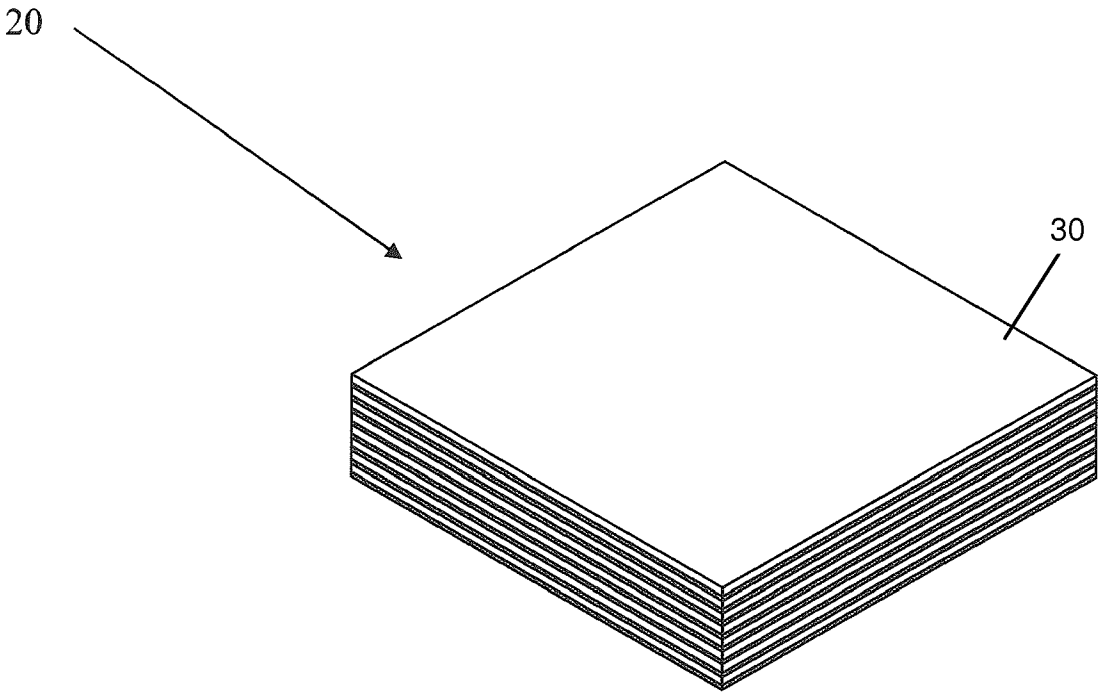
FIG. 4 schematically shows the stack of coaster shown in FIG. 3 after the stained coaster is removed, in accordance with an embodiment of the invention.

FIG. 3 schematically shows stack 20 of coasters 30 shown in FIG. 2 with container 40 removed and the stained top coaster being peeled off the stack to expose a new coaster 30, schematically shown in FIG. 4, unstained by liquid 42.

Figure 5:
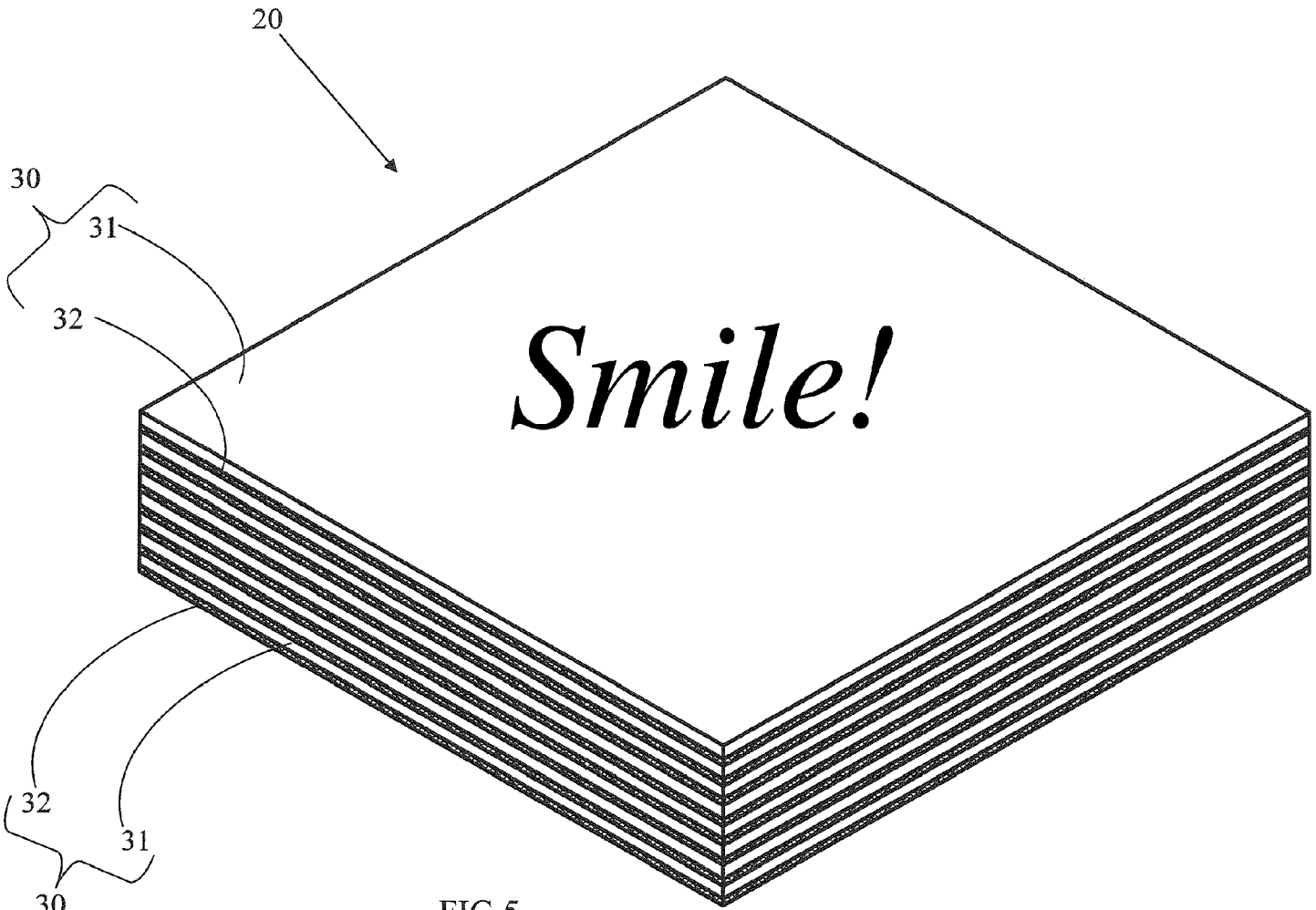
FIG. 5 schematically shows the stack of coasters shown in the preceding figures with a top coaster in the stack used to jot down a note, in accordance with an embodiment of the invention.

FIG. 5 schematically shows stack 20 shown in FIG. 4 with the new unstained coaster 30 exposed by removal of the stained coaster having the word "Smile" written on writable layer 31 of the coaster. Optionally the coaster will be used as a sticky note with "Smile" stuck to a friend's computer screen.

It is noted that whereas in the above description a coaster comprises a writable layer bonded to an impermeable layer, practice of the invention is not limited to a coaster comprising a layer bonded to an impermeable lay. For example, in some embodiments of the invention, the coaster comprises a layer of optionally writable material impregnated by a material, such as a suitable polymer, that makes at least a portion of the writable material impermeable to liquid.

In some embodiments of the invention, a Poster-Coaster Pack comprises a stack of sheets of paper or other writable material interleaved with sheets of liquid impermeable material that are not integrally bonded to the sheets of writable material. Optionally, each sheet of liquid impermeable material is held in the stack by an adhesive region that sticks the sheet of liquid impermeable material to a sheet of writable material below it in the stack so that the liquid impermeable sheet may be readily peeled off the writable sheet.

It is further noted that an embodiment of the invention does not necessarily include a sheet of material configured for relative ease of writing thereon. A Poster-Coaster Pack" in accordance with an embodiment of the invention may comprise a stack of disposable coasters that are not configured for ease of being written on, which are held in the stack by an adhesive so each disposable coaster may readily be peeled off from a coaster below it in the stack. Optionally the coaster are held in the stack by a bonding layer similar to boding layer 36 shown in FIG. 1C.

In the description and claims of the present application, each of the verbs, "comprise" "include" and "have", and conjugates thereof, are used to indicate that the object or objects of the verb are not necessarily a complete listing of components, elements or parts of the subject or subjects of the verb.

Descriptions of embodiments of the invention in the present application are provided by way of example and are not intended to limit the scope of the invention. The described embodiments comprise different features, not all of which are required in all embodiments of the invention. Some embodiments utilize only some of the features or possible combinations of the features. Variations of embodiments of the invention that are described, and embodiments of the invention comprising different combinations of features noted in the described embodiments, will occur to persons of the art. The scope of the invention is limited only by the claims.

The invention claimed is:

1. A product for supporting a drinking container, comprising:

a stack of coasters, each coaster comprising a liquid absorbent layer having first and second surfaces, which absorbent layer absorbs liquid through the first surface and comprises a sheet of paper, and wherein the first surface is adapted for writing thereon;

a material that operates to prevent the liquid from penetrating from the first surface through the coaster; and an adhesive on the second surface of each coaster lying above another coaster in the stack that holds the coasters in the stack so that a top coaster in the stack may readily be removed from the stack.

2. A product according to claim 1 wherein the material that operates to prevent the liquid from penetrating from the first surface through the coaster comprises an impermeable layer bonded to the absorbent layer.

3. A product according to claim 1 wherein the material that operates to prevent the liquid from penetrating from the first surface through the coaster comprises a material that impregnates the absorbent layer.

4. A product for supporting a drinking container, comprising:

a stack of coasters, each coaster comprising a liquid absorbent layer having first and second surfaces, which absorbent layer absorbs liquid through the first surface, and a material that operates to prevent the liquid from penetrating from the first surface through the coaster, wherein the absorbent layer comprises a sheet of paper and the first surface is adapted for writing thereon; and a layer of bonding material that adheres to edges of the coasters located along a same side of the stack to hold the coasters in the stack so that a top coaster in the stack may readily be removed from the stack.

5. A product according to claim 4 wherein the material that operates to prevent the liquid from penetrating from the first surface through the coaster comprises an impermeable layer bonded to the absorbent layer.

6. A product according to claim 4 wherein the material that operates to prevent the liquid from penetrating from the first surface through the coaster comprises a material that impregnates the absorbent layer.

* * * * *